US005797196A

United States Patent [19]

Stanfield

[11] Patent Number: 5,797,196

[45] Date of Patent: Aug. 25, 1998

[54] SEED CORN DRYING SYSTEM AND METHOD

[76] Inventor: Zenas A. Stanfield, 106 S. Vale St., Bloomington, Ill. 61701

[21] Appl. No.: 799,631

[22] Filed: Feb. 12, 1997

[51] Int. Cl.[6] ..... F26B 3/00

[52] U.S. Cl. ..... 34/494; 34/169; 34/171; 34/175

[58] Field of Search ..... 34/395, 449, 487, 34/495, 514, 549, 65, 66, 77, 86, 169, 170, 171, 174, 175, 216, 219, 494

[56] References Cited

U.S. PATENT DOCUMENTS

| | | | |
|---|---|---|---|
| 1,297,727 | 3/1919 | Petty | 34/233 |
| 4,050,164 | 9/1977 | Campbell | 34/182 |
| 4,064,638 | 12/1977 | Stanfield | 34/174 |
| 4,139,952 | 2/1979 | Stanfield | 34/380 |
| 4,212,115 | 7/1980 | Adler | 34/215 |
| 4,800,653 | 1/1989 | Steffen | 34/495 |

*Primary Examiner*—Henry A. Bennett
*Assistant Examiner*—Steve Gravini
*Attorney, Agent, or Firm*—Dickinson Wright PLLC

[57] ABSTRACT

A method for providing higher yielding seed corn comprising a single-pass, reversing, high air velocity process. Another aspect of the invention concerns a conversion panel for converting a dual-pass seed corn drying system into a single-pass system.

17 Claims, 4 Drawing Sheets

SEED CORN DRYING SYSTEM AND METHOD

CROSS-REFERENCE TO RELATED APPLICATIONS

This application claims the benefit of U.S. Provisional applications No. 60/011,476, filed Feb. 12, 1996 and No. 60/020,598, filed Jun. 26, 1996 which are herein incorporated by reference.

FIELD OF THE INVENTION

This invention relates to a method for drying grains, in particular, seed corn and an apparatus for adapting conventional seed grain dryers to operate in an improved manner. More specifically, the invention relates to a single-pass higher air velocity method for drying and an apparatus for adapting convention dual-pass dryers to operate as single-pass systems.

BACKGROUND OF THE INVENTION

Methods for increasing the efficiency of drying and quality of the seed corn has always been a priority of the seed corn industry. This especially so in light of the ever rising cost of drying equipment and fuel which has increased the focus on improving the overall throughput of the equipment. The conventional wisdom in the industry is that seed corn quality and equipment efficiency were opposing factors. This means it was understood that operational changes to increase the overall throughput of the equipment adversely affected the quality of the seed corn and measures to increase the quality of the seed corn resulted in decrease in utilization of the equipment.

For purposes of this application the use of the term seed corn in drying operations is understood to mean seed corn in the form of ears with the kernels still on the ears. Presently, seed corn is most commonly dried in large multi-bin dual-pass seed corn dryer systems similar to those discussed in U.S. Pat. No. 4,212,115. These dryers comprise a plurality of separate bins disposed along the sides of a dual-pass air plenum. The seed corn is dried in these dual-pass systems by supplying ambient air heated to about 95°–105° F. into the fresh air plenum, typically the upper plenum. This heated ambient air is blown through partially dried seed corn and out into the lower pass plenum. As the air passes through the corn, it removes moisture from the corn and experiences a temperature drop. This lower temperature, moisture laden air is then passed through newly picked, higher moisture seed corn. As the air passes through this corn, again, it picks up additional moisture and is further cooled. This air is then exhausted to atmosphere.

It is the conventional wisdom in the industry that the lower the saturation level of the exhausted air the lower the efficiency of the drying operation. Consequently, conventional systems are designed and operated with a focus on the saturation level in the exhaust air. Accordingly, the volume of air is designed to provide the desired saturation level in the exhaust air. This is typically between 25–35 CFM of air/Bushel of shelled out seed corn.

Attempts to increase the utilization of the equipment using the conventional method of drying has resulted in sacrificing the quality of the seed corn. For example, the increased demand on equipment costs has led to the practice of extending the harvesting season by picking corn as early as mid to late August. This practice allows more batches to be processed through the equipment prior to the killing frost.

The problem with this early harvesting practice is the moisture content of the corn is higher, than later in the season, and so is the average ambient air dewpoint. These factors combine to make the most undesirable conditions for drying the seed corn. Therefore, the seed corn must remain in the dryers, exposed to the relatively high temperatures of the heated air, for extended periods. This of course adversely effects the quality and yielding potential of the seed corn. The high saturation levels in the exhaust air has even been found to induce germination within the dryers which further decreases the quality and yielding potential of the seed corn.

Accordingly, there is a need to provide a seed corn drying method that increases the utilization of the equipment while improving the quality of the seed corn.

It is therefore an object of the present invention to provide an improved method for drying seed corn, particularly, in these most unfavorable conditions which usually occur early in the harvesting season.

It is another object of the present invention to provide an improved method of drying seed corn that provides better utilization of the drying equipment.

It is yet another object of the present invention to provide a method for drying seed corn where the drying air remains substantially below saturation.

It is still another object of the present invention to provide an apparatus for adapting conventional dual-pass dryer systems to single-pass dryer systems so that they may be operated in accordance with the improved drying method of the present invention.

It still a further object of the present invention to provide an apparatus to convert existing two-pass dryer systems into single-pass systems.

SUMMARY OF THE INVENTION

The present invention involves a method of producing higher yielding seed corn by reducing the temperature and exposure time necessary to adequately dry the seed corn. This method comprises blowing heated air through a pile of seed corn at very high velocity. While not wanting to be held to any particular theory, it has been theorized that high velocity air reduces the thickness of the high humidity film about the surface of the seed corn thereby increasing the removal rate of moisture from the seed corn. In addition, the higher volume of heated air introduces more heat energy into the system. It has been theorized that this higher heat energy vaporizes the moisture in the corn while the air is still able to maintain a relatively high temperature as it passes through the pile resulting in more rapid and uniform drying across the seed corn pile. The method of the present invention maintains a high differential in vapor pressure between the surface of the seed corn and the drying air which contributes to greater mass transfer of water vapor from the seed corn to the drying air.

DETAILED DESCRIPTION OF THE INVENTION AND THE PREFERRED EMBODIMENTS THEREOF

Figure 1:
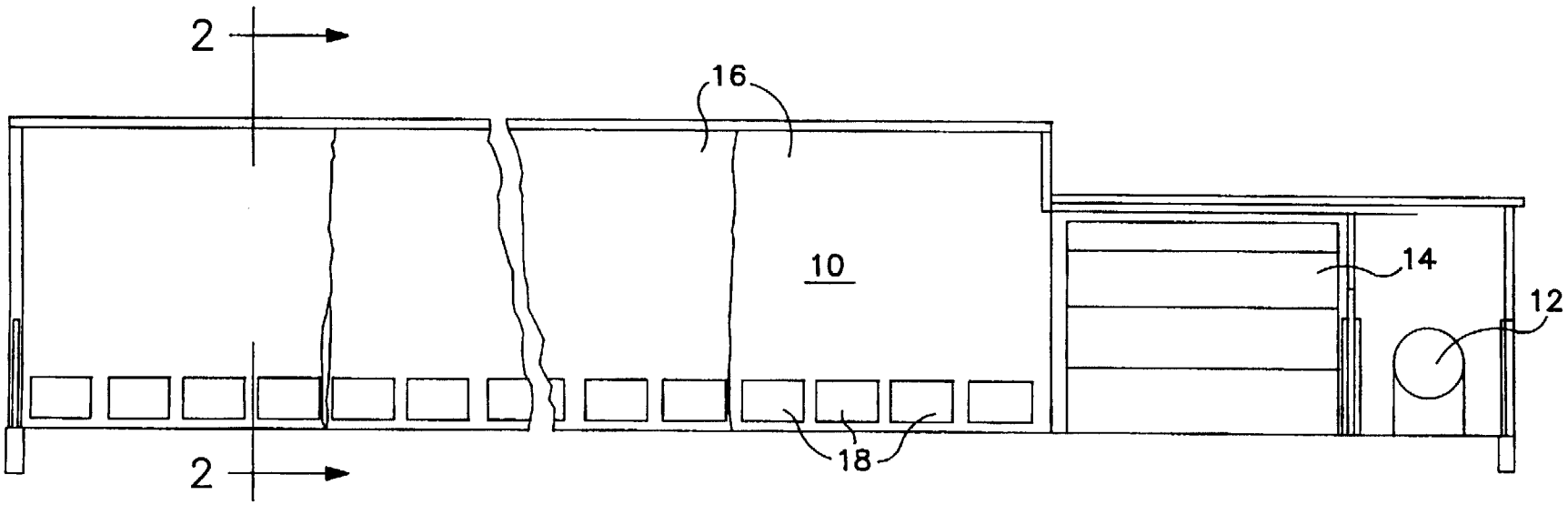
FIG. 1 is a side elevation view of a conventional dual-pass dryer system.
Figure 2:
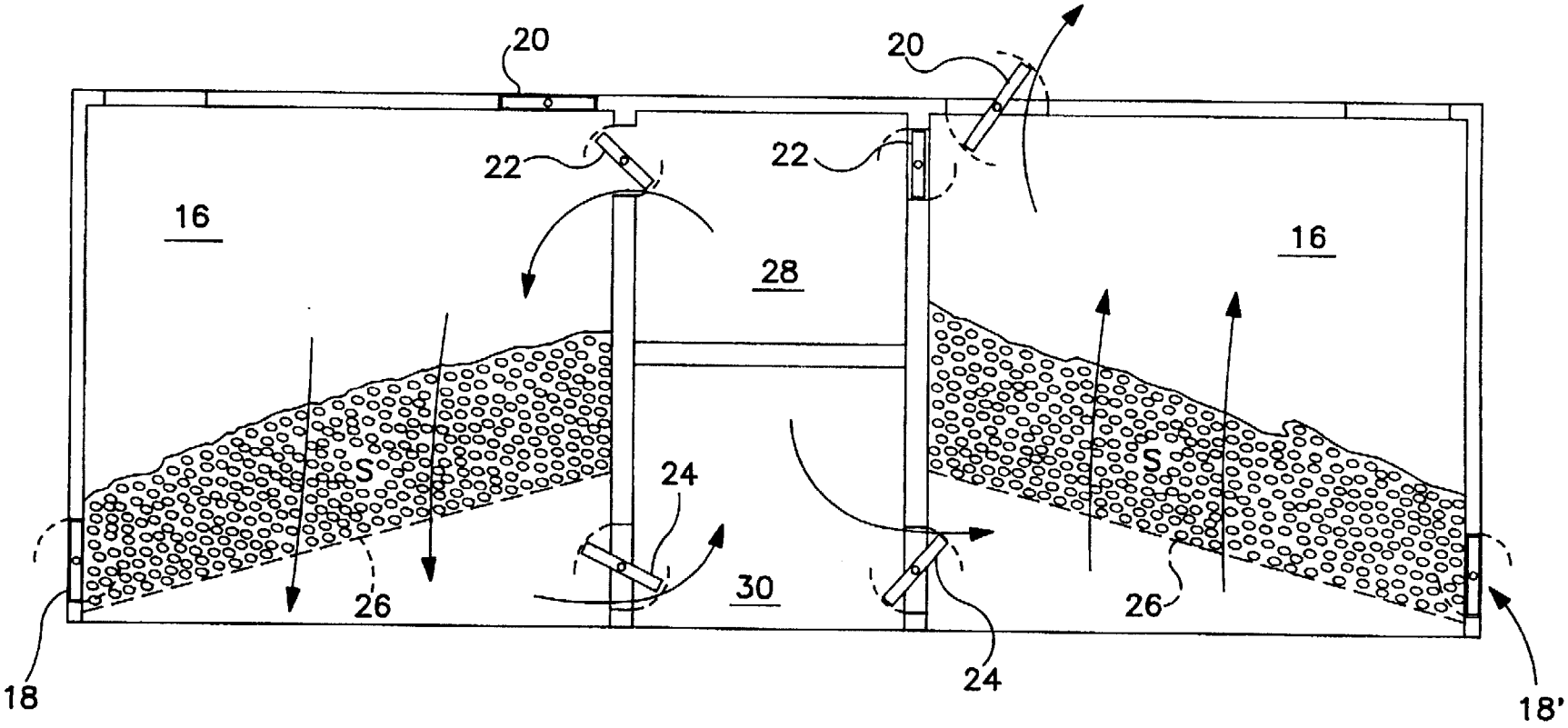
FIG. 2 is a side elevation sectional view of the conventional dual-pass dryer system of FIG. 1 taken along line 2—2.

FIG. 1 depicts a conventional seed corn dryer system 10 comprising an air handling unit, having an air blower 12 and an air heating unit 14, and a series of bins 16. Each bin 16, as best shown in FIG. 2, has at least one load-out door 18, grain loading door 20, upper plenum door 22 and a lower plenum door 24 as well as a sloping perforated floor 26. The center of the dryer system comprises two air plenums, an upper plenum 28 and a lower plenum 30.

In operation, the air blower 12 draws ambient air through the heating unit 14 and blows it into the upper plenum 28. The air travels along the upper plenum and into a bin 16 through an open upper plenum door 22. The air passes down through the pile of seed corn S and through the perforated sloping floor 26 picking up some moisture from the seed corn. This same, now moisture laden partially cooled, air then travels from the bin 16 out into the lower plenum 30 through the lower plenum door 24. Once in the lower plenum 30, it travels into a second bin 16 (may be any one of the bins in the system) that has the grain loading door 20 and lower plenum door 24 open. It then travels in through the lower plenum door 24, below the perforated floor, up through the floor 26 and pile of seed corn S and exhausts out through the grain loading door 20.

Figure 3:
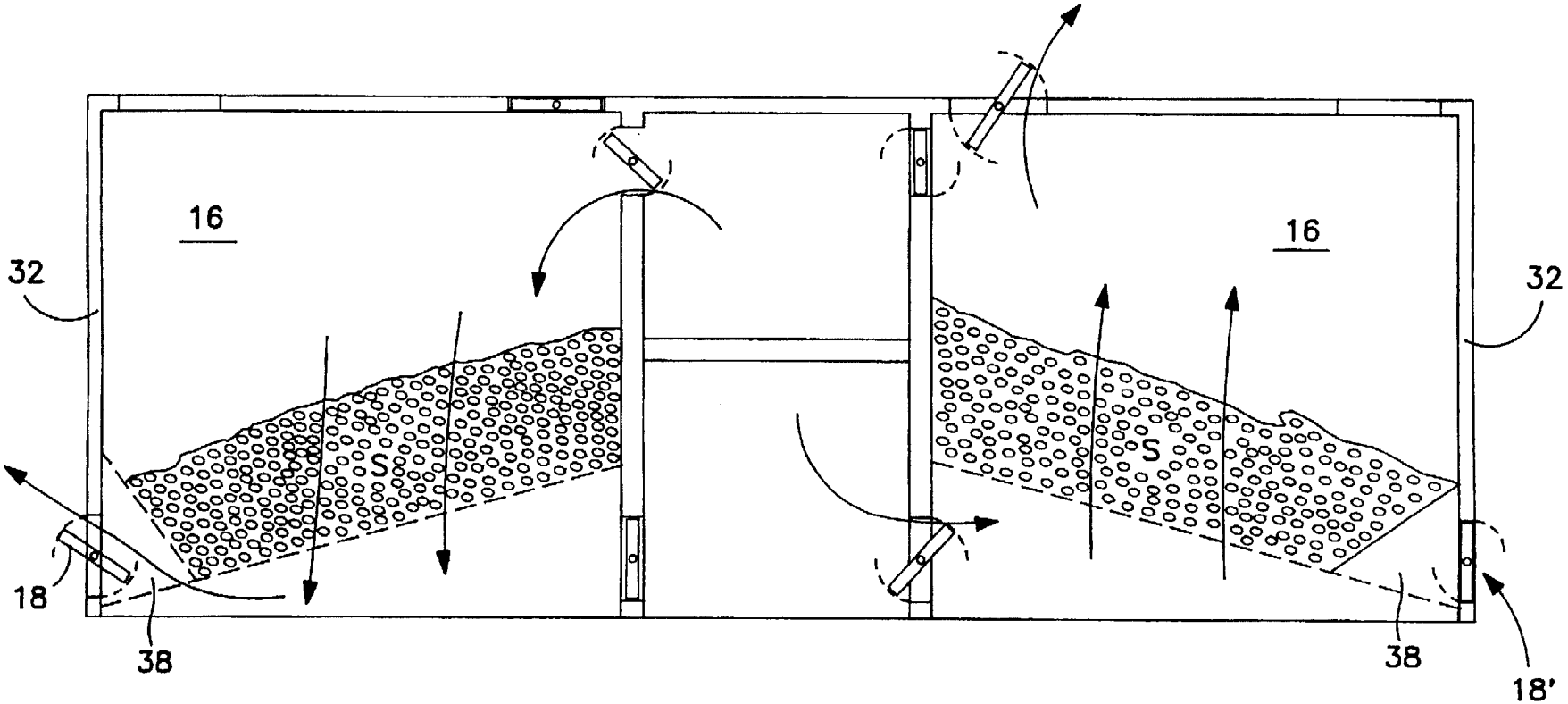
FIG. 3 is a side elevation view of a modified conventional dryer system of FIG. 2 fitted with conversion panels of the present invention.

The present system enables conventional dual-pass drying systems such as the type depicted in FIGS. 1 & 2 and discussed above to be converted to a single-pass system. The conversion is accomplished by using at least one conversion panel 40, see FIGS. 3 & 4. The at least one conversion panel 40, as shown in FIG. 3, is fitted between the lower end of the sloping perforated floor 26 and the outside wall 32, opposite the plenum, of the bin 16. The conversion panel bridged in this manner supports the seed corn away from the load-out door 18 and creates an air space 38 between the seed corn pile and the load-out door 18. The system may need to be further adapted by adding an additional blower for the lower plenum or opening the lower plenum up to either the upper plenum or the outlet of the air heating unit so that heated ambient air is passed to this plenum.

Figure 4:
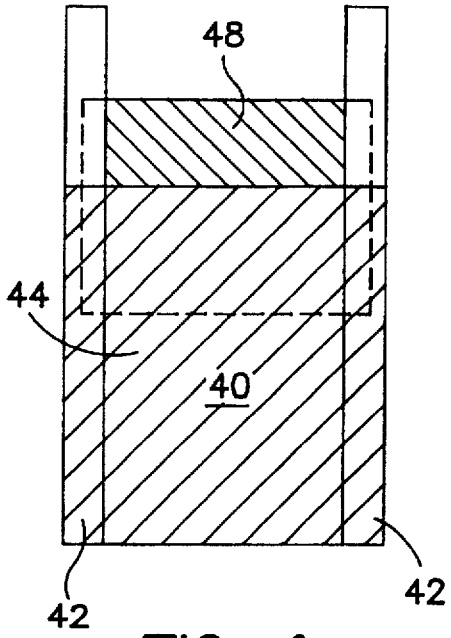
FIG. 4 is a plan view of a conversion panel in accordance with the present invention in a partially open position.
Figure 5:
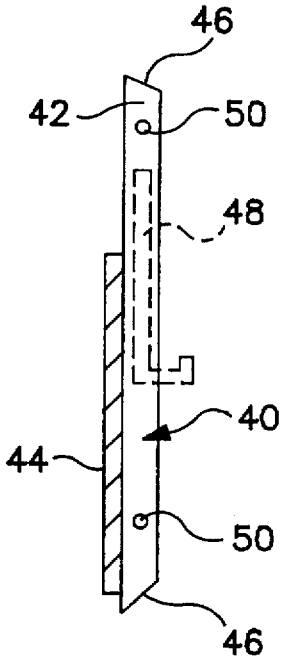
FIG. 5 is a side elevation view of the conversion panel of FIG. 4.

The conversion panel 40 may be any suitable panel for supporting the seed corn away from the load-out door. One embodiment of the conversion panel 40 is depicted in FIGS. 4 & 5. The panel 40 comprises a pair of substantially parallel elongated members 42 defining the length of the panel. A substantially flat member 44 is joined along two opposing sides to the elongated members 42. The flat member extends from one end of the elongated members 42 up along the length of the elongated members. The flat member 44 may extend substantially the full length of the elongated members 42. The flat member 44 may be solid but is preferably perforated.

The conversion panel 40 may be equipped with a sliding gate 48 for enabling seed corn to selectively pass from the bin out through the load-out door without removing the panel 40. The sliding gate may be joined to the panel in any suitable manner. For example the gate can be a second flat member slidingly joined to the panel within a pair of tracks positioned in the elongated members 44.

The panel 40 may be equipped with a variety of options. For instance, the elongated members 44 of the panel be equipped with angular ends 46 to assist in properly positioning the panels within the bins and to allow the ends of the panel to fit more closely against the sloped perforated floor 26 and the side walls 32 of the bin. Another option may include adding a means to join multiple panels 40 together. Panels may be joined by any conventional means including fasteners (not shown) extending through openings 50 spaced along the elongated members.

Once the system has been converted with the conversion panels, it can be operated in single-pass reversing mode in accordance with the present invention. Heated ambient air is supplied to both the upper plenum 28 and lower plenum 30. The air travels from the upper plenum 28 in through an open upper plenum door 22 and down through the seed corn pile S and perforated floor 26, as in the unconverted conventional dryer system. The air then exhausts out through the air space 38 created by the conversion panel and out the open load-out door 18. The heated ambient air in the lower plenum 30 travels into a bin 16 and through the floor 26 and seed corn pile S and exhausts out the top in the same manner as in the unconverted conventional dryer system. The difference is that the air in the lower plenum is heated ambient air not moisture laden partially cooled air.

Once the seed corn has be sufficiently dried, the seed corn S may be unloaded from the converted system by removing the conversion panel or preferably by opening a sliding gate 48 provided in the conversion panel 40. The panel with sliding gate may also assist in regulating the flow of seed corn out to the load-out door.

With the system converted and the air handling unit modified, as necessary, the system can be operated in accordance with the single-pass, reversing, high velocity method of the present invention. The system shall have an air handling unit that will deliver a sufficient volume of heated ambient air so that the velocity per horizontal unit area of the pile of seed corn is at least twice that of the conventional dual-pass dryer systems. Preferably, the air velocity per total horizontal cross-sectional area of the pile will be at least 170 ft/min. More preferably, the air velocity will be or exceed about 200 ft/min per total horizontal cross-sectional area of the pile. This means, for example, that a 400 sq. ft drying bin holding about 1300 bushels of seed corn operating at an air velocity of approximately 200 ft/min, in accordance with the method of this invention, will be supplied with about 80,000 CFM of heated ambient air. Of course the air traveling through the interstices of the seed corn pile will achieve much higher velocities in the order of 1000 ft/min or more.

The depth of the seed corn pile is typically less than about 12 ft and preferably less than about 9 ft so that the pressure drop through the pile is not excessive at these higher velocities. Most preferably, the depth of the seed corn pile will be between about 6.5 and about 7.5 ft.

The ambient air used in this method will be heated up to about 30° and about 40° F. above the ambient temperature. Preferably, the air will be heated to between about 34° and 36° F. above ambient temperature. Alternatively, the drying air could be supplied at a temperature of between about 90° and about 100° F., preferably between about 94° and about 97° F. The heated ambient air will be passed through the seed corn until its moisture content is sufficiently reduced. The moisture content of newly picked seed corn is typically in excess of 30% moisture. The seed corn is typically dried until its moisture content is reduced to between about 11.5 and about 13.5%, preferably between about 12% and about 12.5% moisture.

Optionally, the single-pass, high velocity method of drying the seed corn may include reversing the flow of air through the seed corn at least once during the drying operation. This may be accomplished by opening/closing the appropriate plenum and exhaust doors, i.e. the loading door and the side load-out door. Preferably, the air flow direction will be reversed when the moisture content of the corn has been reduced to between about 18 and about 23%, more preferably about 20%.

EXAMPLES

The following examples compare the single-pass, reversing, higher air velocity method of the present invention with a conventional dual-pass drying method. In both methods, it is assumed that a batch comprises approximately 2,000 bushels of shelled out seed corn having a 35% moisture content and when placed in a 600 sq. ft. drying bin will assume a depth of approximately 10 ft. The seed corn is considered dry when its moisture content is reduced to about 12%. Table 1 and the energy cost calculations below sets forth predictions for drying seed corn using the conventional dual-pass drying method, comparative Example A, and the single-pass, higher air velocity method, Example 1. Table 2 sets forth equipment arrangements and associated costs for Example A with several alternative equipment arrangements for Example 1, using the predictions from Table 1.

ELECTRICITY COST CALCULATION

Example A 60,000 *CFM*=>50 *HP*×84 *HR*=4200 *HP–HR*×0.05 $/*HP–HR*= $210/2000 *Bu* $210/2000 *BU*=0.10 $/*BU*

Example 1

120,000 *CFM*=>175 *HP*×48 *HR*=8400 *HP–HR*×0.05 $/*HP–HR*= $420/2000 *Bu*=$420/2000 *Bu*=0.21 $/*Bu*

Notes:

The horsepower of the blower is based on depth of seed corn and air velocity.

COMBINED ENERGY COST

Example A 0.66 $/*Bu*+0.10 $/*Bu*=0.76 $/*Bu*

Example 1

0.61 $/*Bu*+0.21 $/*Bu*=0.84 $/*Bu*

0.84 $/*Bu*–0.76 $/*Bu*=0.08 $/*Bu* (12% increase in energy cost)

TABLE 1

| EXAMPLE | AIR TEMP. (°F.) | AIR VELOCITY (FT/MIN.) | AIR FLOW (CFM) | AIRFLOW/ BUSHEL (CFM/BU.) | DRYING TIME (HRS.) | CHANGEOVER TIME BETWEEN BATCHES (HRS.) | TOTAL BATCH TIME (HRS.) | TOTAL BIN FILLS PER 30 DAY PERIOD |
|---|---|---|---|---|---|---|---|---|
| A | 105 | 110 | 66,000 | 33 | 84 | 12 | 96 | 75 |
| 1 | 100 | 200 | 120,000 | 60 | 48 | 12 | 60 | 12 |
| | | | | | TOTAL INCREASE IN CAPACITY | | | 60% |

Note:
This data is based on an ambient dry bulb temperature of 60° F.

TABLE 2

| EXAMPLE | BUSHELS/YEAR (IN 1000 BUSHELS) | AIR FLOW (CFM/Bu) | DRYING BINS IN SYSTEM | SYSTEM INVESTMENT (IN MILLION $) | NUMBER OF DAYS IN DRYING SEASON/YEAR |
|---|---|---|---|---|---|
| A | 200 | 30 | 14 | 1.7 | 30 |
| 1(a) | 200 | 60 | 8 | 1.0 | 30 |
| 1(b) | 200 | 60 | 13 | 1.7 | 20 |
| 1(c) | 300 | 60 | 13 | 1.7 | 30 |

FUEL COST CALCULATION

Example A

40(*a*)×33 *CFM/Bu*×1.2(*b*)=1,584 *BTU/Bu–HR*×84 *HR*=133,056 *BTU/Bu* 133,056 *BTU/BU*×5.00 $/million *BTU's*=0.66 $/*Bu*

Example 1

35(*a*)×60 *CFM/Bu*×1.2(*b*)=2,520 *BTU/Bu–HR*×48 *HR*=120,960 *BTU/Bu* 120,960 *BTU/BU*×5.00 $/million *BTU's*=0.61 $/*Bu*

Notes:

(a) temperature difference in °F. between dry bulb of heated air and dry bulb temperature of ambient air.

(b) conversion factor [60 min/hr.×0.02 BTU/°F.–Cu. Ft of air]

Summary of Predictions:

In comparing comparative Example A with Example 1, the data in Table 1 shows that about a 60% increase in capacity could be achieved, at a lower air temperature, by using the single pass high air velocity method of the present invention. The energy cost calculation shows the energy costs would increase only slightly, 8 cents per bushels, by operating in accordance with the present invention. In addition to an increase in capacity, the seed corn would be exposed to lower temperature air in Example 1 and for a shorter period, 48 hours, which would be a little more than half that in Example A, 84 hours. In view of the known harmful effects of exposing seed corn to such high temperatures for extended periods, it seems clear that the seed corn of Example 1 will provide a higher quality, higher yielding seed corn.

Table 2 shows a comparison between comparative Example A and Examples 1 (a–c), based on the predictions set forth in Table 1. Comparing Example 1(a) with comparative Example A, the table shows that the same amount of seed corn can be dried with substantially less equipment and equipment costs. A comparison of Example 1(b) and comparative Example A shows that for the same equipment cost the same amount of seed corn can be dried ten days quicker. This will reduce the chance of losing crop to an early killing frost. A comparison of Example 1(c) with comparative Example A shows that 50% more seed corn can be dried for the same equipment costs.

What is claimed is:

1. A seed corn drying method for providing higher yielding seed corn comprising the steps of:

forming a pile of seed corn in a drying bin; and blowing heated ambient air through said pile at a velocity of at least 170 ft/min per total cross-sectional area of said pile, said velocity being sufficient to substantially prevent said seed corn from germinating in said drying bin.

2. The method of claim 1 wherein said air passes substantially vertically through said pile and said pile has a depth of less than 9 ft.

3. The method of claim 1 wherein said air is heated to between about 90° and about 100° F.

4. The method of claim 1 wherein said air is heated to about 34° and about 36° F. above the ambient air temperature.

5. The method of claim 1 further comprising the step of reversing the direction of said air through said pile.

6. The method of claim 1 wherein said air is blown through said pile until the moisture content of said seed corn has been sufficiently reduced.

7. The method of claim 1 wherein said seed corn has a moisture content in excess of 30% and said air is blown through said pile until the moisture content of said seed corn is reduced to about 12%.

8. The method of claim 1 wherein said air is blown at rate of at least 200 ft/min per total cross-sectional area of said pile.

9. A method for reducing the moisture content of seed corn comprising the steps of:

forming between about 6.5 and about a 7.5 ft high pile of newly picked seed corn in a drying bin; and blowing ambient air heated to between about 34° and about 36° F. above ambient air temperature through said pile at a velocity of at least 170 ft/min per total cross-sectional area of said pile for a sufficient period of time to reduce the moisture content of the seed corn below about 13.5%, said velocity being sufficient to substantially prevent germination of said seed corn in said pile.

10. The method of claim 9 wherein the direction of the air through said pile is reversed.

11. The method of claim 9 wherein the direction of the air through said pile is reversed when the moisture content of the seed corn is reduced to about 20%.

12. A seed corn drying method comprising:

inserting at least one panel into at least one bin of a dual-pass seed corn dryer system having a side load-out door for substantially preventing any seed corn placed into said bin from contacting said load-out door;

forming a pile of seed corn in said at least one bin;

blowing heated air through said pile; and, exhausting said air out said load-out door.

13. The method of claim 12 wherein said air is blown through said pile at a velocity of at least 170 ft/min per total cross-sectional area of said pile.

14. The method of claim 13 wherein said panel comprises opening means for selectively allowing seed corn to pass through said panel.

15. A device comprising an apparatus for converting a dual-pass grain dryer to a single-pass dryer comprising a floor for supporting a pile of grain to be dried, at least one side load-out door, and a support for holding said grain in said pile away from said side load-out door and creating an air space between said grain in said pile and said side load-out door.

16. The apparatus of claim 15 wherein said support is perforated.

17. The apparatus of claim 15 wherein said support comprises a gate for selectively allowing seed corn to pass within.

* * * * *